United States Patent [19]

Schaffner et al.

[11] 4,363,554

[45] Dec. 14, 1982

[54] SETTING MECHANISM FOR AN ANALOG DISPLAY WATCH

[75] Inventors: Jean-Claude Schaffner, Delemont; Jacques Müller, Reconvilier, both of Switzerland

[73] Assignee: ETA S.A., Fabriques d'Ebauches, Switzerland

[21] Appl. No.: 350,138

[22] Filed: Feb. 19, 1982

[30] Foreign Application Priority Data

Feb. 26, 1981 [CH] Switzerland ..... 279/81

[51] Int. Cl.[3] ..... G04B 27/02

[52] U.S. Cl. ..... 368/190; 368/184; 368/185

[58] Field of Search ..... 368/34, 145, 184, 185, 368/190–195

[56] References Cited

U.S. PATENT DOCUMENTS 3,827,235 8/1974 Bachmann ..... 368/190

*Primary Examiner*—Ulysses Weldon

*Attorney, Agent, or Firm*—Philip M. Hinderstein

[57] ABSTRACT

The mechanism has a sliding and rotary stem 2 for controlling two functions of a digital display watch. The stem 2 carries a fixed pinion 4. An intermediate gear 6 is mounted rotatably at the end of a rocking lever 32. Pivotal movement of the lever 32 against the action of a spring 36 is produced by the stem 2. In a first position of the stem 2, the gear 6 is in mesh with a date setting wheel 8 but out of mesh with the pinion 4. In a second position, the gear 6 is engaged by the pinion 4 and remains in mesh with the wheel 8. In a third, fully pulled out position, the gear 6 remains engaged by the pinion 4 and is pulled out of mesh with the wheel 8 and into mesh with a time setting wheel 10.

4 Claims, 4 Drawing Figures

SETTING MECHANISM FOR AN ANALOG DISPLAY WATCH

BACKGROUND OF THE INVENTION

The present invention concerns a setting mechanism for an analog display watch having functions which are to be mechanically controlled separately. For example, this involves correcting the time and correcting the date of the month. The analog display watch may be mechanical or electronic.

In most cases, such mechanisms comprise a stem which can be moved into three positions, comprising a neutral position and two active positions. Mounted on the end of the stem is a sliding pinion (castle wheel) which is free to move along the stem but which is non-rotatable relative to the stem. In order to define the axial position of the sliding pinion with respect to the axial position of the stem, the mechanism further comprises a system of two levers which are generally referred to on the one hand as the pull-out piece or setting lever and on the other hand as the return bar or yoke. The pull-out piece is rocked by the stem and acts on the return bar which in turn shifts the sliding pinion in the opposite direction to the movement of the stem.

Such mechanisms are efficient but they make it necessary to cut the sliding pinion, and the cutting operation requires a high degree of precision.

It is for this reason that it has already been proposed that the pinion should be fixed with respect to the stem. However, in the proposed construction, the pinion can only engage with a single gear and such a mechanism can therefore only be used to control a single function, namely, setting the time.

SUMMARY OF THE INVENTION

The object of the present invention is to provide a setting mechanism which makes it possible mechanically to control a plurality of functions but wherein the pinion is fixed in respect of rotary and translatory movement to the stem.

According to the present invention, there is provided a setting mechanism for a watch comprising a support structure, two toothed wheels for setting two functions of the watch and having axes of rotation which are parallel to each other, a stem which is movable axially in a direction perpendicular to the axes of the wheels and which carries a toothed pinion which is fixed with respect to the stem, means for holding the stem in any one of three axial positions in which respectively rotary movement of the stem does not cause any rotary movement of the wheels, rotary movement of the stem causes rotary movement of the first wheel, and rotary movement of the stem causes rotary movement of the second wheel, an intermediate gear which is mounted rotatably about a displaceable axis which is parallel to the axes of the wheels and means for displacing the intermediate gear, these means being controlled by the movements of the stem, so that the intermediate gear is engaged with the first wheel and is free with respect to the pinion when the stem is in the first position, the intermediate gear is engaged with the pinion and remains engaged with the first wheel when the stem is in the second position and the intermediate gear remains engaged with the pinion and is engaged with the second wheel, when the stem is in the third position.

It will be seen that, with this arrangement, not only is the pinion fixed with respect to the component, but in addition one of the two levers which are normally employed is omitted, thereby further simplifying production and assembly of the mechanism.

In a preferred embodiment, the intermediate gear is mounted at the end of a pivotal lever. Pivotal movement of the lever is produced by a resilient member one end of which is in a position of abutment against the support structure or the case of the watch. In the first position, the resilient member is slightly tensioned and holds the lever against a stop in such a way that the intermediate gear is engaged with the first wheel but is free with respect to the pinion. In the second position of the stem, the lever does not move and remains in contact with the stop while the pinion meshes with the first wheel. Finally, in the third position, the pinion which moves with the stem acts on the lever and causes the lever to pivot in a direction in which the stop does not act on the lever, the resilient system being further compressed. The intermediate gear disengages from the first wheel and engages with the second wheel.

BRIEF DESCRIPTION OF THE DRAWING

The invention will be described in more detail, by way of example, with reference to the accompanying drawings, in which.

DETAILED DESCRIPTION OF THE PREFERRED EMBODIMENT

Figure 1:
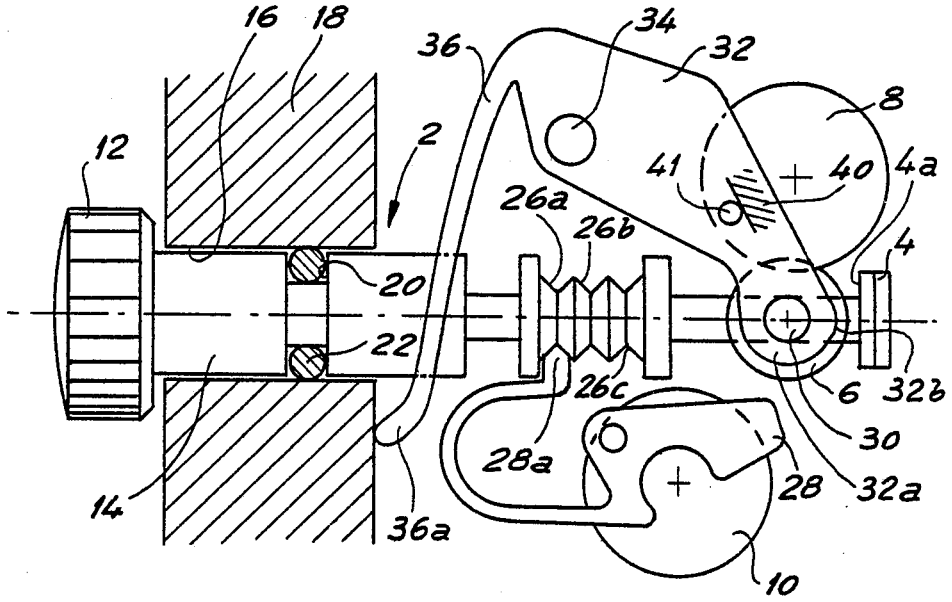
FIG. 1 is a plan view of the whole of the setting mechanism.

As already described hereinbefore, the mechanism essentially comprises a stem 2, at the end of which is mounted a pinion 4 which co-operates with an intermediate gear 6. The axes of the pinion 4 coincides with the axial axes of the stem 2. The mechanism can engage with a first toothed wheel 8 which is for example the wheel for correcting the date and possibly the day of the week, and with a second toothed wheel 10 for correcting the time. The gear 6 is mounted rotatable about an axis which can be displaced, in a manner to be described hereinafter, but which remains parallel to the axes of the wheels 8 and 10.

The stem 2 firstly comprises a button 12 in order for the user of the watch to be able to move the stem axially and rotate the stem and the pinion 4. The stem comprises a longitudinal guide portion 14 which co-operates with the bore 16 in the support structure 18 of the watch to guide the stem 2 in respect of sliding an rotary movement. The guide portion 14 is provided with a groove 20 for a seal 22. The stem further comprises three grooves 26*a*, 26*b* and 26*c* which co-operate with an end 28*a* of a detent spring 28, thereby to define three axial positions of the stem 2. In FIG. 1, the end 28*a* of the spring 28 is engaged with the groove 26*a*, defining the neutral position of the stem. Finally, at its end, the stem 2 comprises the toothed pinion 4 which is in the form of a castle wheel with face teeth 4*a*. Preferably, the button 12 and the pinion 4 are made at the same time as the other operations of machining the stem 2.

The member which provides for movement of the gear 6 is as follows. The gear 6 is mounted rotatably about a pin 30 which is fixed to an end 32*a* of a lever 32, which will be referred to hereinafter as the "rocker lever". The rocker lever 32 is mounted pivotally about an axis 34 which is fixed with respect to the support structure of the watch. The rocker lever 32 is extended beyond the axis 34 by an extension portion 36 which forms a spring blade. The end 36*a* of the extension portion 36 is in a position of abutment against the wall of the support structure 18 of the watch case. That is to say, the end 36*a* is stationary with respect to the support structure, in the direction of displacement of the stem.

Finally, the mechanism comprises a stop 40 which is fixed with respect to the support structure and which can co-operate with a lug or stud 41 which is fixed on the rocker lever 32. The abutment is so positioned that, when the stem 2 is in a rest condition, that is to say, in the position shown in FIG. 1, the gear 6 does not engage with the pinion 4. It will be appreciated that this mechanical stop 40 can be formed by any suitable means, and constitutes a unidirectional abutment.

It will be appreciated also that the wheels 8 and 10 and the gear 6 are in the same plane which is displaced with respect to the axis of the stem 2. That plane is defined by the diameter of the pinion 4. It will also be appreciated that the rocker lever 32 is disposed in a plane which is parallel to the plane of the gear 6, 8 and 10 and which does not contain the axis of the stem 2.

Figure 2A:
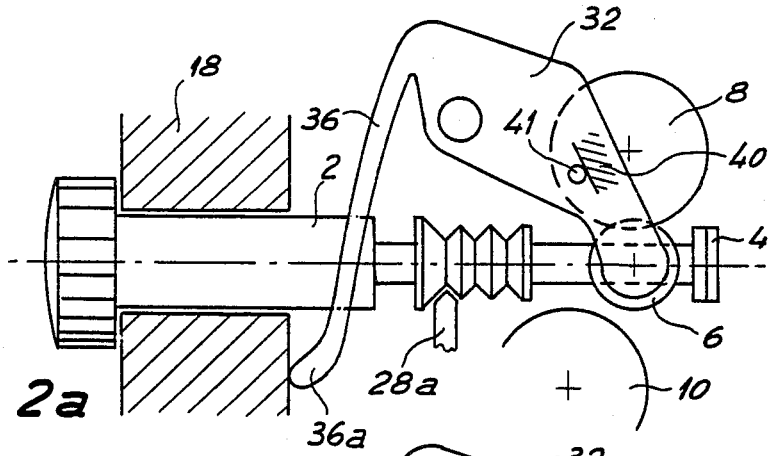
FIGS. 2*a* to 2*c* are diagrammatic views illustration the mode of operation to the mechanism.
Figure 2B:
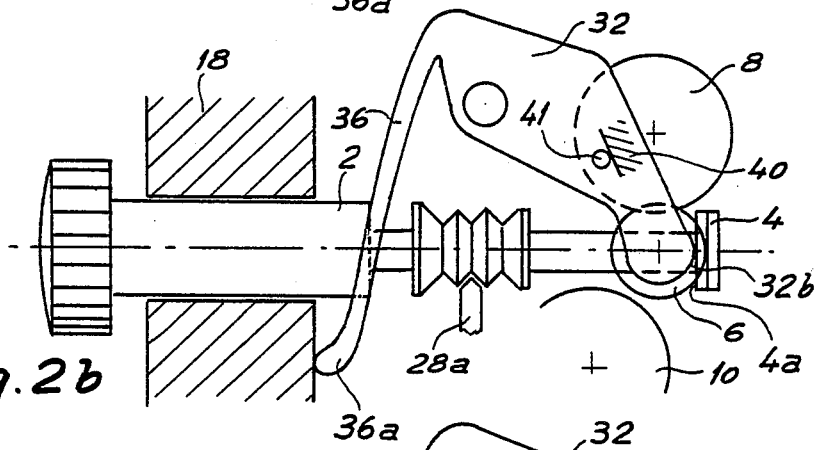
Figure 2C:
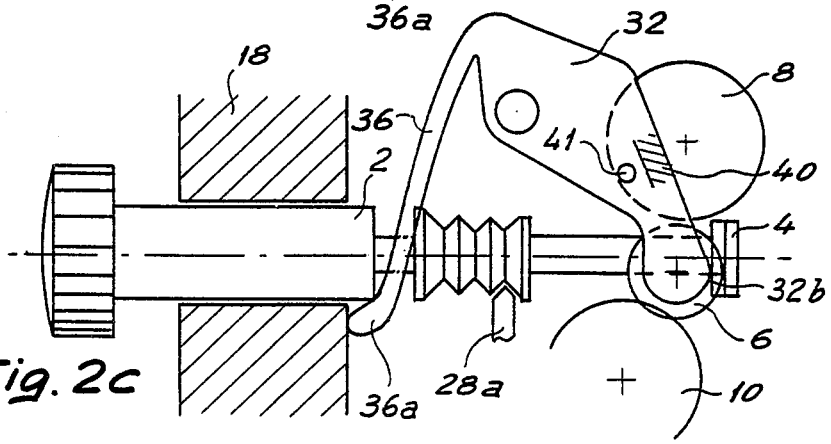

FIGS. 2*a* to 2*c* illustrate the mode of operation of the mechanism.

In FIG. 2*a*, the stem 2 is pushed completely in, which corresponds to the neutral position in which the stem can be rotated without acting on the wheel 8 or 10. The stem 2 is held in that position by virtue of the end 28*a* of the spring being engaged in the groove 26*a*. The spring blade 36 is so shaped that, with the stem 2 in that position, the lug 41 of the rocker lever is held against the fixed stop 40 by slight stressing of the spring 36, the end 36*a* of which bears against the wall 18. The gear 6 is engaged with the first wheel 8 but not with the pinion 4 on the stem 2. Rotary movement of the stem 2 therefore does not have any effect.

FIG. 2*b* shows the position of the mechanism for driving the wheel 8. When the user moves the stem 2 into the second position illustrated, the gear 6 does not move and therefore remains engaged with the wheel 8. The travel of the stem is such that the pinion 4 comes into mesh with the gear 6. The rocker lever 32 does not move. It is held stationary by the tensioning of the spring 36 which holds the lug 41 against the fixed stop 40. As regards the stem 2, it is held in that position by the end 28*a* of the spring 28 engaging in the groove 26*b*. If the user then rottes the stem 2, the rotary movement of the pinion 4 causes rotary movement of the gear 6 which in turn rotates the wheel 8, thereby providing for example for correction of the date.

FIG. 2*c* shows the mechanism in its second active position, for driving the wheel 10. When the stem 2 moves from the first active position to this second active position, the translatory movement of the stem 2 causes the rocker lever 32 to pivot about its axis 34 due to the action of the pinion 4 on the gear 6. Preferably in fact, in the position shown in FIG. 2*b*, the untoothed surface 4*a* of the pinion 4 is in contact with the edge portion 32*b* of the end of the lever 32 carrying the gear 6. When the arrangement is moved from the first active position (FIG. 2*b*) to the second active position (FIG. 2*c*), it is preferably the portion 4*a* of the pinion which by being displaced with the stem 2, acts on the edge portion 32*b* of the rocker lever and causes pivotal movement thereof. It will be appreciated that, during this movement, the spring blade 36 is further tensioned. In that movement, the gear number 6 comes into mesh with the wheel 10, after having come clear of the wheel 8. The stem 2 is held in that position by the end 28*a* of the spring engaging in the groove 26*c*. In that position, by turning the stem 2 the user rotates the wheel 10 for altering the time. The pivotal movement of the rocker lever is of such an extent that, in both the second and third positions of the stem, the gear 6 is properly engaged with the pinion 4.

When the user moves the stem 2 successively into the second axial position and then the first axial position, the spring 36 acts as a return spring since the end 36*a* thereof is fixed with respect to the support structure of the watch.

It will be seen from the foregoing description that the control mechanism, the subject of this invention, is substantially simplified in comparison with the mechanisms of the prior art.

In particular, the pinion is an integral part of the control stem, which considerably simplifies the machining operations. In addition, the pull-out piece is omitted, thereby simplifying assembly of the mechanism. However, these simplifications do not result in any disturbance or breakdown in operation of the mechanism, in particular as regards engagement of the different pinions or wheels when the control stem moves from one position to another.

What is claimed is:

1. A setting mechanism for a watch comprising a support structure, first and second toothed wheels having axes of rotation which are parallel to each other;

a stem which is movable axially in a direction perpendicular to the axes of said wheels, and rotatable about said direction;

a pinion which is fixed with respect to said stem, said pinion being coaxial with said stem, means for holding said stem in any one of three axial positions, an intermediate gear which is mounted about a displaceable axis; and means for displacing said axis in response to the movement of said stem and maintaining said axis parallel to the axes of said wheels, said intermediate gear being engaged with said first wheel and free with respect to said pinion when said stem is in the first position, said intermediate gear being engaged with said pinion and remaining engaged with said first wheel when said stem is in the second position, and said intermediate gear remaining engaged with said pinion and engaging with said second wheel when said stem is in the third position.

2. A setting mechanism according to claim 1, wherein said displacement means comprises a lever which is mounted pivotally about a fixed axis parallel to the axes of said wheels, said displaceable axis being mounted on said lever; resilient means having a first end which is fixed with respect to said lever and a second end abutting said support structure; and a stop member which is fixed with respect to said support structure and cooperating with said lever for maintaining said intermediate gear in engagement with said first wheel under the effect of said resilient means, when said stem is in said first and second positions, and said pinion cooperating with the assembly formed by said intermediate gear and said lever for causing said lever to pivot about its axis and said intermediate gear to bring in engagement with said second wheel when said stem is moved into said third position.

3. A setting mechanism according to claim 2, wherein said lever has a first and a second end, said desplaceable axis of said intermediate gear being mounted at the first end of said lever, and said resilient means comprise a spring blade integral with said lever, said first end of said blade coinciding with said second end of said lever.

4. A setting mechanism according to claim 3, wherein said blade spring is slightly stressed when said lever cooperates with said stop member.

* * * * *